United States Patent [19]

Pesch et al.

[11] Patent Number: 4,907,938

[45] Date of Patent: Mar. 13, 1990

[54] LOADING APPARATUS FOR A PLATEN PRESS USED IN MAKING PARTICLE BOARD

[75] Inventors: Jürgen Pesch; Gottfried Konig, both of Krefeld, Fed. Rep. of Germany

[73] Assignee: G. Siempelkamp GmbH & Co., Krefeld, Fed. Rep. of Germany

[21] Appl. No.: 339,970

[22] Filed: Apr. 14, 1989

Related U.S. Application Data

[63] Continuation of Ser. No. 67,967, Jun. 29, 1987, abandoned.

[30] Foreign Application Priority Data

Jul. 5, 1986 [DE] Fed. Rep. of Germany ..... 3622665

[51] Int. Cl.[4] ..... B27N 3/22

[52] U.S. Cl. ..... 414/749; 414/222; 198/586; 198/631; 100/196; 100/207; 100/215

[58] Field of Search ..... 414/749, 750, 222; 198/586, 631; 100/196, 207, 215; 271/198, 200

[56] References Cited

U.S. PATENT DOCUMENTS

| | | | |
|---|---|---|---|
| 1,521,820 | 1/1925 | Lloyd | 198/631 X |
| 3,243,054 | 3/1966 | Petersen | 414/749 |
| 3,426,886 | 2/1969 | Aro | 198/586 X |
| 3,482,675 | 12/1969 | Hütz | 198/586 |
| 3,750,804 | 8/1973 | Lemelson | 414/276 |
| 3,804,228 | 4/1974 | Felstehausen | 198/631 X |
| 4,104,847 | 8/1978 | Glandon et al. | 198/631 X |
| 4,119,193 | 10/1978 | Smith et al. | 198/631 X |
| 4,682,685 | 7/1987 | Yamada et al. | 414/750 X |

FOREIGN PATENT DOCUMENTS

| | | | |
|---|---|---|---|
| 1279706 | 10/1968 | Fed. Rep. of Germany | 198/631 |
| 69364143 | 1/1970 | Fed. Rep. of Germany . | |
| 695888 | 8/1953 | United Kingdom | 198/586 |

OTHER PUBLICATIONS

Modern Particleboard & Dry-Process Fiberboard Manufacturing, Thomas M. Maloney, 1977, Miller Freeman Publications; pp. 461–467.

*Primary Examiner*—Frank E. Werner
*Assistant Examiner*—William M. Hienz
*Attorney, Agent, or Firm*—Herbert Dubno

[57] ABSTRACT

The loading apparatus for a platen press with at least one press stage used in making particleboard, especially chipboard and/or fiberboard, from a mat comprises a loading frame which has at least one loading stage and a belt tray insertable into the panel press in the loading stage and removable therefrom. The belt tray comprises a drive drum shaft with a drive drum mounted rigidly thereon, a delivery lip and a belt guided endlessly over the drive drum and the delivery lip. The conveyor when the belt tray returns from the press for delivery of the mat is driven by a rack fixed to the frame and an associated pinion on the drive drum shaft. The pinion is mounted losely on the drive drum shaft and is nonrotatably connected with one half of a clutch whose other half is nonrotatably connected with the drive drum shaft. The tray conveyor drive is shiftable into and out of engagement with the drum shaft and is reversible not only for receiving one of the mat segments but also with the rotation direction reversed for ejection of one of the mat segments into a recovery funnel positioned upstream of the loading frame in the loading direction. The clutch also is disengageable when the belt tray travels out on the loading frame and is engaged when the belt tray returns.

3 Claims, 3 Drawing Sheets

LOADING APPARATUS FOR A PLATEN PRESS USED IN MAKING PARTICLE BOARD

This application is a Continuation of application Ser. No. 07/067,967 filed Jun. 29, 1987, now abandoned.

FIELD OF THE INVENTION

Our present invention relates to a loading or charging apparatus for a platen press used in the manufacture of particle board, especially chipboard or fiberboard.

BACKGROUND OF THE INVENTION

A platen press with at least one press stage or level is often used in making particleboard, especially chipboard and/or fiberboard, from a mat of particles or fiber.

A loading apparatus for the platen press can comprise a loading frame which has at least one loading stage or level and a belt tray insertable into the platen press from the loading stage during charging of the press, and retractable therefrom.

The belt tray comprises a drive drum shaft with a drive drum mounted rigidly thereon, a delivery lip and belt guided endlessly over the drive drum and the delivery lip.

The drive drum in the initial position of the belt tray is connectable to a belt drive positioned on the loading frame for the loading stage. The belt tray is guided on two guide rails of the loading frame and is movable in and out on the loading frame by a reciprocating drive with a rack on the belt tray and a drive pinion on the frame engageable with the rack. Further, this tray conveyor belt is drivable with the aid of a belt drive in the initial position of the belt tray to receive a mat. This belt, when the belt tray is advanced into the platen press for delivery of the mat, is drivable also by at least one fixed delivery rack and an associated delivery pinion mounted on the drive drum shaft for delivery of the mat. It is understood that with a platen press with a plurality of press stages the loading frame has a corresponding number of loading stages or levels.

In the known loading apparatus, the delivery pinion is mounted on the drum shaft through a free running clutch. The arrangement is such that the drum shaft and thus the drum is not driven when the conveyor tray travels out on the loading frame (i.e. extends into the press) and the delivery pinion is in mesh with the fixed delivery rack because the clutch permits free running of the pinion.

The free running is however blocked so that the delivery pinion can drive the drum shaft when the belt tray has traveled out of the loading frame into the platen press so that a mat on the belt is delivered to the press.

This system has proved to be satisfactory. However, a mat located on the belt tray on the loading frame which cannot be delivered to the press on account of a defect in the platen press or a failure of removal of a previously pressed mat is not taken back and fed into a recovery unit whose funnel can be located upstream of the loading frame so that the material can be reprocessed.

With such a defect, other precautions or steps have been taken.

With a defect in the finished plate transport the finished plates leaving the platen press are pushed into a stack. However, then the usual cooling process does not occur and a plate taken off in this case must be marketed as a plate of lower or reduced quality. Frequently, it is even necessary that the defectively pressed plates be thrown out.

Of course, one can consider shutting down apparatus for the duration of the defect. This however has the result that mats or finished plates remaining in the platen press can be set afire in the platen press.

OBJECTS OF THE INVENTION

It is an object of our invention to provide an improved loading apparatus for a platen press used in making particleboard, especially chipboard or fiberboard, which will avoid the drawbacks.

It is also an object of our invention to provide an improved loading apparatus for a platen press used in making particleboard, especially chipboard or fiberboard, in which a mat located on a belt tray in the loading frame can be taken back and fed into a recovery funnel positioned upstream of the loading frame in the event of a press disorder, e.g. for recycling of that mat material to the mat-forming particle dispenser.

SUMMARY OF THE INVENTION

These objects and others which will become more readily apparent hereinafter are attained in accordance with our invention in a loading apparatus for a platen process with at least one press stage used in making particleboard, especially chipboard and/or fiberboard, from a mat.

The loading apparatus comprises a loading frame which has at least one loading stage and a belt tray insertable into the platen press in the loading phase and retractable therefrom.

The belt tray comprises a drive drum shaft with a drive drum mounted rigidly thereon, a delivery lip and a tray conveyor belt guided endlessly over the drive drum and the delivery lip.

The drive drum in the initial position of the belt tray is connectable to a belt drive on the loading frame in the loading stage. The belt tray is guided on at least two guide rails of the loading frame and is movable in and out on the loading frame by a reciprocating drive with a rack on the belt tray and a drive pinion on the loading frame. Further, the tray conveyor belt is drivable with the aid of a belt conveyor drive in the initial position of the belt tray for receipt of a mat. The belt tray is also driven as it is displaced into the platen press for delivery of the mat by at least one delivery rack fixed to the loading frame and an associated delivery pinion mounted on the drum shaft for delivery of the mat.

According to our invention, the delivery pinion is mounted loosely on the drum shaft and is nonrotatably connected with one half of a clutch whose other half is nonrotatably attached to the drive drum shaft.

The belt drive is shiftable into engagement with the shaft and the clutch is engaged not only for receipt of one of the mats but also with its rotation direction reversed for ejection of a mat into a material-recovery funnel positioned upstream of the loading frame with respect to the loading direction. The clutch is disengaged when the belt tray travels out on the loading frame and is engaged when the belt tray returns to deposit a mat in the press during the return movement.

The clutch can also be disengaged during the latter movement so that on return of a belt tray fed into the platen press a delivery of the mat to the press is precluded because the clutch remains out of engagement.

This allows mats then on the belt tray to be discharged into the funnel, taken off without delivery to the press when a press operation interruption occurs, by the reverse operation of the belt drive upon engagement with the shaft.

Our invention can make use of a variety of clutches. In the simplest case, the clutch is an electromagnetically operable jaw clutch because such a clutch, on the one hand, provides a positive coupling and, on the other hand, in a simple way can be remotely operable by a cable.

It is not necessary to provide a clutch on both sides of the drive drum shaft. Advantageously, a delivery pinion and a clutch are located only on one side of the drive drum shaft and the belt tray is guided with sliding members on two guide rails without tilting. The sliding members takeup the torque which results from the fact that a delivery pinion and a clutch are provided on only one side of the drive drum.

BRIEF DESCRIPTION OF THE DRAWING

The above and other objects, features and advantages of our invention will become more readily apparent from the following description, reference being made to the accompanying highly diagrammatic drawing in which.

Specific Description

Figure 1:
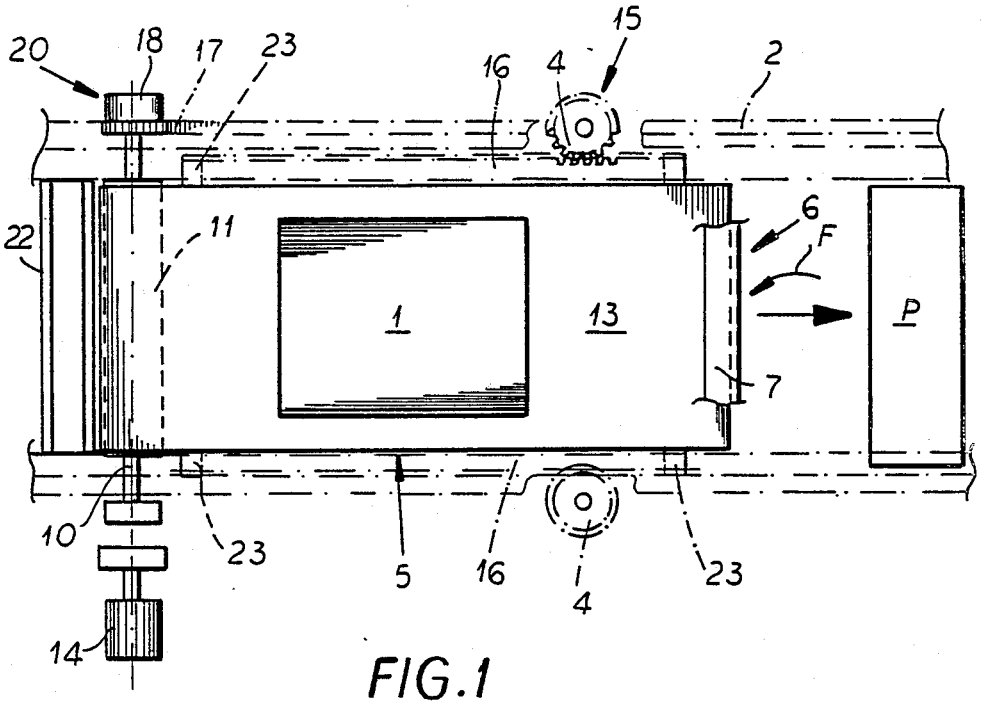
FIG. 1 is a top plan view of part of a loading apparatus for a platen press according to our invention with a belt tray.

The apparatus shown in the drawing is a loading apparatus for a platen press P with at least one stage or level used in the manufacture of particleboard, especially chipboard or fiberboard.

The platen press P is shown only as a block but is located downstream of the loading apparatus, i.e. to the right in FIG. 1.

The loading apparatus comprises a loading frame 2 to which the frame components 3, 4 belong which has t least one loading stage and a belt tray 5 which can be fed into the open platen press P in the loading stage and retracted from it.

Figure 2:
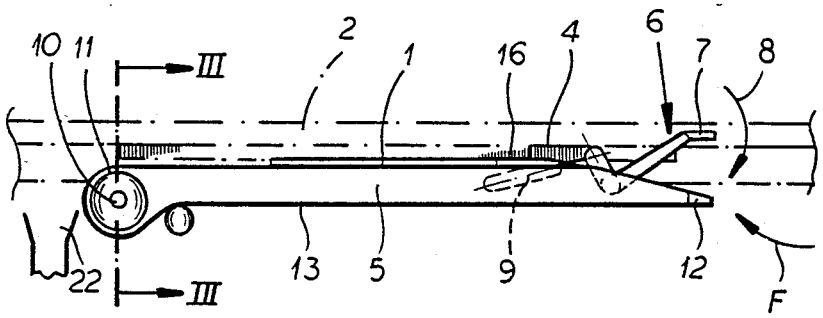
FIG. 2 is a side-elevational view of the belt tray of FIG. 1.

The belt tray 5 (FIG. 2) has a device 6 on its front end F which acts to push a finished plate from the press P as the belt tray 5 is moved into the latter. The pusher member 7 is moved downwardly in the direction of the arrow 8 by a piston-and-cylinder arrangement 9 so that it can engage the rear edge of a previously pressed plate and push it from the press P. In FIG. 1 the pusher member 7 is shown broken away so that the delivery pinions 4 can be better seen.

The belt tray 5 (FIGS. 1 and 2) has a drive drum shaft 109 with a drive drum 11 attached rigidly to it, a delivery lip 12 and a tray conveyor belt 13 guided endlessly over the drive drum 11 and delivery lip 12.

The shaft 10 of the drive drum 11 is connectable to a belt drive 14, mounted in loading frame 2, during the loading phase in its loading stage in the initial position of the belt tray 5 which corresponds to that shown in FIG. 1.

Figure 3:
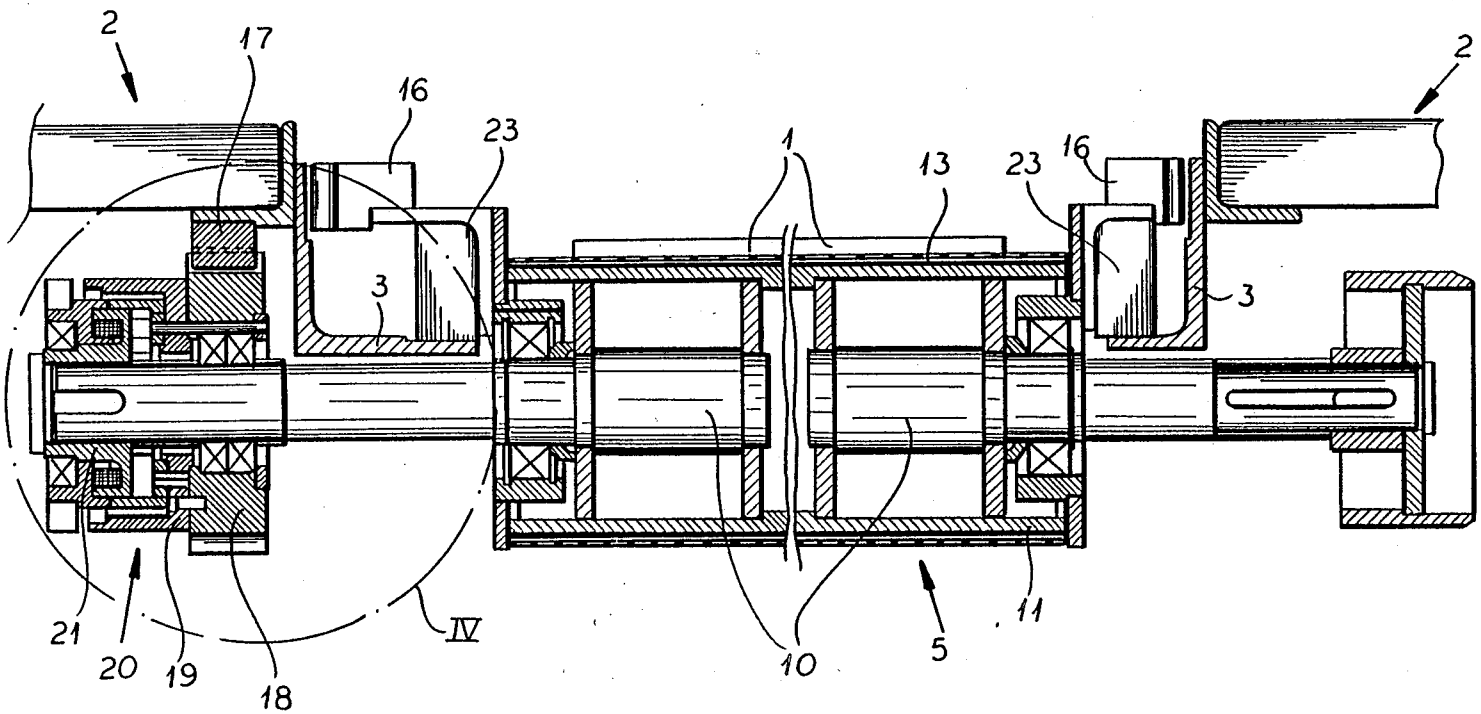
FIG. 3 is an enlarged transverse cross sectional view taken along the line III—III of FIG. 2.

The belt tray 5 is guided on the guide rails 3 (FIG. 3) of the loading frame 2 and travels in and out on the loading frame 2. For this movement, a reciprocating drive 15 has racks 16 fixed to tray 5 and drive pinion 4 on the loading frame 2, FIGS. 1 and 3.

The tray conveyor belt 13 is drivable with the aid of the tray belt drive 14 in the initial position of the belt tray 5 shown in FIG. 1 in a forward direction for receiving the mat 1 and in a reverse direction upon retraction of the belt tray 5 returning from the press P. For delivery of the mat section 1 to the associated platen of the platen press P, a delivery rack 17 is fixed on the loading frame 2 and is engaged by an associated delivery pinion 18 mounted on the drive drum shaft 10.

Figure 4:
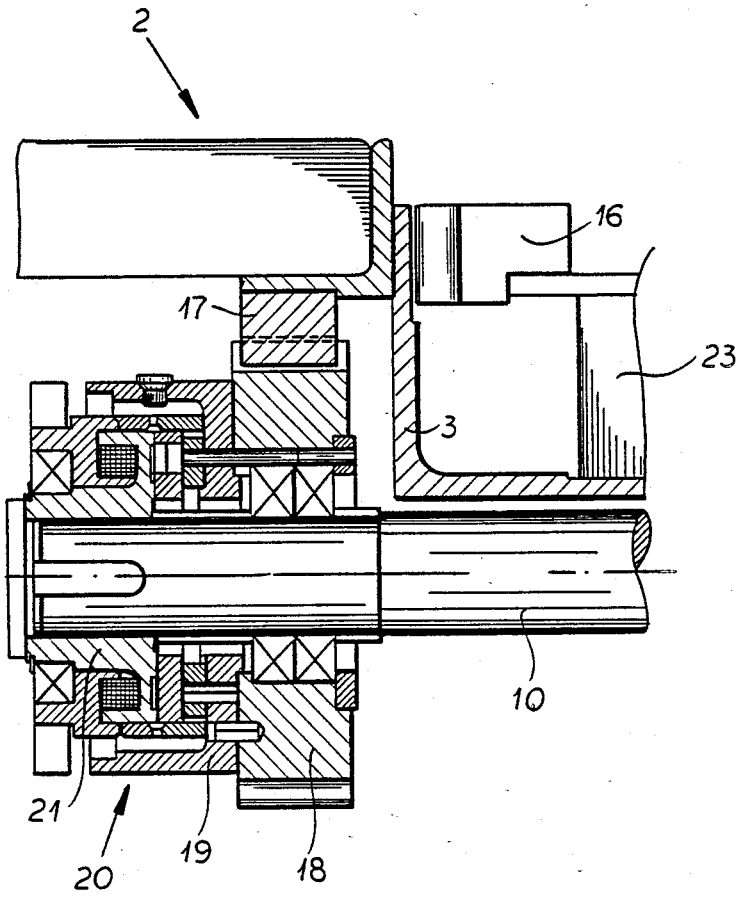
FIG. 4 is a further enlarged cross sectional view of the portion IV of the device shown in FIG. 3.

The delivery pinion 18 (FIGS. 3 and 4) is mounted rotatably on the drive drum shaft 10 and is attached nonrotatably to one half 19 of a clucth 20 whose other half 21 is nonrotatably attached to the drive drum shaft 10.

The drive 14 is engageable with the shaft 10 and can be driven with clutch 20 disengaged not only for receipt of a mat 1 but also in the reverse rotation direction, i.e. selectively, for throwing a received mat 1 into an recovery funnel 22 positioned upstream of the loading frame 2 in the loading direction.

On delivery of the mat 1 to the belt 13 the drive 14 operates in its forward direction with the clutch 20 disengaged. Moreover, the clutch 20 is disengageable on shifting of the belt tray 5 from the loading frame 2 into the press P and is engageable as the belt tray 5 returns to the press to deposit the mat 1 in the press. The clutch 20 is constructed as an electromagnetic remotely operable clutch. A delivery pinion 18 and the associated clutch 20 are located only on one side of the drive drum shaft 10. The belt tray 5 is guided secure from tilting with the sliding members 23 on the guide rails 3. The sliding members 23 take-up torques which result from the fact that a delivery pinion 18 is provided only on one side of the drive drum shaft 10.

To recapitulate, the apparatus of the invention allows the following modes of operation:

(A) For advance of a mat 1 onto the belt 13, the belt tray 5 is disposed in its mat-receiving position shown in FIG. 1 and the belt drive 14 is moved into engagement with the shaft 10 and drives the belt in one direction to displace the mat 1 onto the belt to the right as shown in FIG. 1.

(B) Should it be necessary to discharge the mat 1 from the belt 13 with the belt tray 5 in the mat-receiving position, the drive 14 upon engagement with the shaft 10 is driven in the opposite direction to deposit the mat in the hopper 22.

(C) With the clutch 22 disengaged, the belt tray 5 is advanced by the pinions 4 into the press P, the pusher 7 being lowered to displace a previously pressed plate from the press.

(D) The pusher 7 is then raised and the belt tray 5 retracted by the pinions 4. The clutch 20 is engaged so that the pinion 18, engageable by the rack 17, will rotate the drum and displace the belt 13 to the right during retraction of the belt tray to deposit the mat in the press.

(E) Once the belt tray is in the press and it is necessary to withdraw the mat 1 thereon because of a defect, the clutch 20 is disengaged and the belt tray 5 is moved to the left by the pinions 4 until the belt tray is again in its positions shown in FIG. 1. The drive 14 is then displaced into engagement with the shaft 10 and rotated in the reverse direction to deposit the material in the hopper 22.

We claim:

1. A loading apparatus for a platen press for making particleboard from mats, comprising:

a loading frame disposed adjacent said platen press;

a recycling funnel disposed upstream of said loading frame for receiving mats;

a belt tray on said loading frame displaceable between a mat-receiving position within said frame and a mat depositing position wherein said belt tray extends from said frame into said press, said belt tray comprising:

a shaft;

a drum rotatable with said shaft, a discharge lip spaced from said drum, and a belt passing around said drum and said lip for receiving said mat;

a belt drive on said frame selectively engageable with said shaft in said receiving position of said belt tray for rotating said shaft and displacing said belt to advance a mat onto said belt tray and, selectively, upon the development of a defect, for reversing the displacement of said belt to deposit a mat on said belt into said funnel;

a tray drive comprising:

a rack fixed on said belt tray, and a pinion on said frame engaging said belt tray rack and rotatable to displace said tray between said positions;

a delivery drive including:

a rack fixed on said frame, and a pinion engaging said frame rack and rotatable on said shaft and, upon coupling to said shaft, rotating said drum and displacing said belt as said tray is retracted from said press to deliver a mat on said belt into said press; and an electromagnetic clutch having one clutch half nonrotatably connected to said pinion on said shaft and another clutch half connected to said shaft and selectively engageable to couple said clutch halves to displace said belt as said tray is retracted, for delivery of a mat to said press, and disengageable to enable said tray to retract without belt displacement and a mat on said belt to be returned from said press to said frame for deposit in said funnel by said belt drive.

2. The apparatus defined in claim 1, further comprising guide means along opposite sides of said belt tray for absorbing torsion forces applied to said belt tray and guiding said belt tray on respective rails of said frame, said clutch being provided on only one side of said drive.

3. The apparatus defined in claim 2, further comprising a pusher on said belt tray at said lip and swingable into a position enabling it to push a previously pressed plate from said press upon advance of said belt tray into said press.

* * * * *